US005564583A

United States Patent [19]

Kelley et al.

[11] Patent Number: 5,564,583

[45] Date of Patent: Oct. 15, 1996

[54] PORTABLE CARRIER FOR A BEVERAGE CONTAINER

[76] Inventors: David J. Kelley, 1124 Parkwood, Wichita, Kans. 67208; Ian West, 1228 Westloop, Suite 232, Manhattan, Kans. 66502

[21] Appl. No.: 439,655

[22] Filed: May 12, 1995

[51] Int. Cl.[6] ..... F25D 3/08

[52] U.S. Cl. ..... 220/23.83; 220/902; 220/903; 220/760; 220/770; 62/372

[58] Field of Search ..... 220/902, 23.83, 220/903, 760, 768, 770, 774; 62/372

[56] References Cited

U.S. PATENT DOCUMENTS

| | | | |
|---|---|---|---|
| 81,817 | 9/1868 | Nuellens et al. . | |
| D. 246,562 | 12/1977 | Stoddard | D7/78 |
| D. 259,614 | 6/1981 | Angelakos | D7/70 |
| D. 282,138 | 1/1986 | Gullikson | D7/300 |
| D. 290,572 | 6/1987 | Verduyn | D7/70 |
| D. 318,974 | 8/1991 | Muller-Soppart | D7/308 |
| 2,216,202 | 10/1940 | Lake | 43/56 |
| 2,652,698 | 9/1953 | Schlumbohm | 62/80 |
| 3,452,469 | 7/1969 | White | 43/55 |
| 3,734,336 | 5/1973 | Rankow | 220/902 |
| 3,754,408 | 8/1973 | Littleton | 62/302 |
| 3,977,552 | 8/1976 | Lombardo | 215/13 |
| 3,998,072 | 12/1976 | Shaw | 62/457 |
| 4,005,586 | 2/1977 | Lyons | 62/372 |
| 4,030,227 | 6/1977 | Oftedahl | 43/56 |
| 4,078,701 | 3/1978 | Clubb | 222/130 |
| 4,255,944 | 3/1981 | Gardner et al. | 62/457 |
| 4,809,522 | 3/1989 | deNevers et al. | 62/457 |
| 4,961,324 | 10/1990 | Allan | 62/400 |
| 5,251,460 | 10/1993 | DeMarco et al. | 62/371 |
| 5,325,988 | 7/1994 | Ekern | 220/411 |

*Primary Examiner*—Joseph M. Moy
*Attorney, Agent, or Firm*—Head, Johnson & Kachigian

[57] ABSTRACT

A portable carrier for a beverage container has a base member with an open top and closed bottom, the open top communicating with a cavity defined by an upper portion of selected cross-sectional dimension and a lower portion of reduced cross-sectional dimension providing an internal ledge, the base member having external integral opposed boss portions having openings therethrough. A cover member has a closed top and open bottom with a cavity therein communicating with the open bottom, the cover member telescopically mating with the base member when in the closed position, the cover member having integral external opposed boss portions with openings. A cord extends through the openings in the boss portions of the cover member and the base member with knots at the ends thereof so that thereby the cord serves the dual function of providing means for carrying the portable carrier as well as preventing inadvertent misplacement of the cover member. A beverage container can be positioned in the base member to rest on the internal ledge. Ice can be placed in the base member lower portion to cool the beverage in the container.

1 Claim, 4 Drawing Sheets

PORTABLE CARRIER FOR A BEVERAGE CONTAINER

CROSS-REFERENCE TO PENDING APPLICATIONS

This application is not related to any pending United States or foreign patent application.

CROSS-REFERENCE TO MICROFICHE APPENDIX

This application is not related to any microfiche appendix.

BRIEF SUMMARY OF THE INVENTION

The invention provides a portable carrier for a beverage container. While the device may be used for carrying a variety of beverage containers, it is particularly useable for carrying a "growler jug", a type of container commonly used to contain beer.

The portable carrier includes a base member having a closed bottom and an open top. The open top communicates with a cavity in the base member, the cavity being defined by an upper portion of selected cross-sectional area dimensioned to receive a beverage container and a lower portion of reduced cross-sectional area less than that of the beverage container. The two different cross-sectional areas provides an internal circumferential ledge spaced from the closed bottom. The base member further has diametrically opposed enlarged dimensional boss portions that each have an opening therein.

A cover member has a closed top and an open bottom. The open bottom communicates with a cavity in the cover member. The cover member open bottom and the base member open top telescopically and removably engage each other. When the cover member is positioned on the base member a closed internal cavity is provided. The cavity in the cover member permits a portion of a container carried by the base member to extend upwardly and within the cover member when the cover member is in closed position.

The cover member has integral enlarged dimensioned external boss portions. These boss portions have opposed openings. The boss portions of the cover member and the base member are, when the cover member is in closed position on the base, in alignment with each other.

A cord extends through the cover member openings and through the base member openings. A knot is tied in each end of the cord below the base member boss portions.

Stiff washers are placed on the cord adjacent each end and above the knots therein. These stiff washers serve to resist the possibility of the knot pulling through the openings in the base member integral boss portions. The use of the washers is particularly important if the base member is manufactured of foam plastic.

When a container, such as a growler jug, is positioned within the base portion, the lower end of the container rests on the internal circumferential ledge. This leaves an area within the bottom of the base portion and below the container bottom which can be filled with ice. In this way the carrier functions as a cooler.

The base member and the cover member are preferably dimensioned so that the container employed in conjunction with the portable carrier is of a height that the top extends above the top of the base member and is received by the cover when the cover is in closed position. This arrangement permits a handle on the container to be above the base top portion so that when the cover is removed, the container is easily removable.

The arrangement of the cover member is such that it can be slid on the rope, that is, the rope can pass through the openings in the cover boss portions. Thus, the cover is always attached to the base portion whether or not the cover is in the closed position or the open position.

The design of the base member having an interior configuration of two different dimensions means that if a smaller diameter container is employed that has a cross-sectional area less than the reduced cross-sectional area portion of the cavity, the container can rest within the reduced cross-sectional area and directly on the container bottom to thereby permit the portable carrier to receive a taller container.

Others have provided devices for beverage containers. U.S. Pat. No. 4,255,944 entitled "Server For Wine Bottles and The Like" is an example of a container that provides a space for ice below the beverage container. However, this device does not employ an integral ledge, is not easily transportable and does not have the other advantageous of the portable carrier as herein described.

U.S. Pat. No. 4,809,522 entitled "Server For Display and Keeping Cool Wine Bottles And The Like" does not provide means for carrying a beverage container.

U.S. Pat. No. 4,961,324 entitled "Refrigerated Beverage Container" shows a carrier but wherein portions of the beverage container extends externally of the carrier and it does not have provision for receiving ice.

U.S. Pat. No. 5,325,988 entitled "Insulated Jacket For Beverage Bottle" shows an insulated device but without a space for ice or a handle for carrying.

A better understanding of the invention will be obtained from the following detailed description of the preferred embodiment, taken in conjunction with the attached drawings and the claims.

DESCRIPTION OF THE DRAWINGS

FIGS. 6 and 7 do not show the cord as is employed for carrying the portable carrier.

DETAILED DESCRIPTION OF THE PREFERRED EMBODIMENTS

Figure 1:
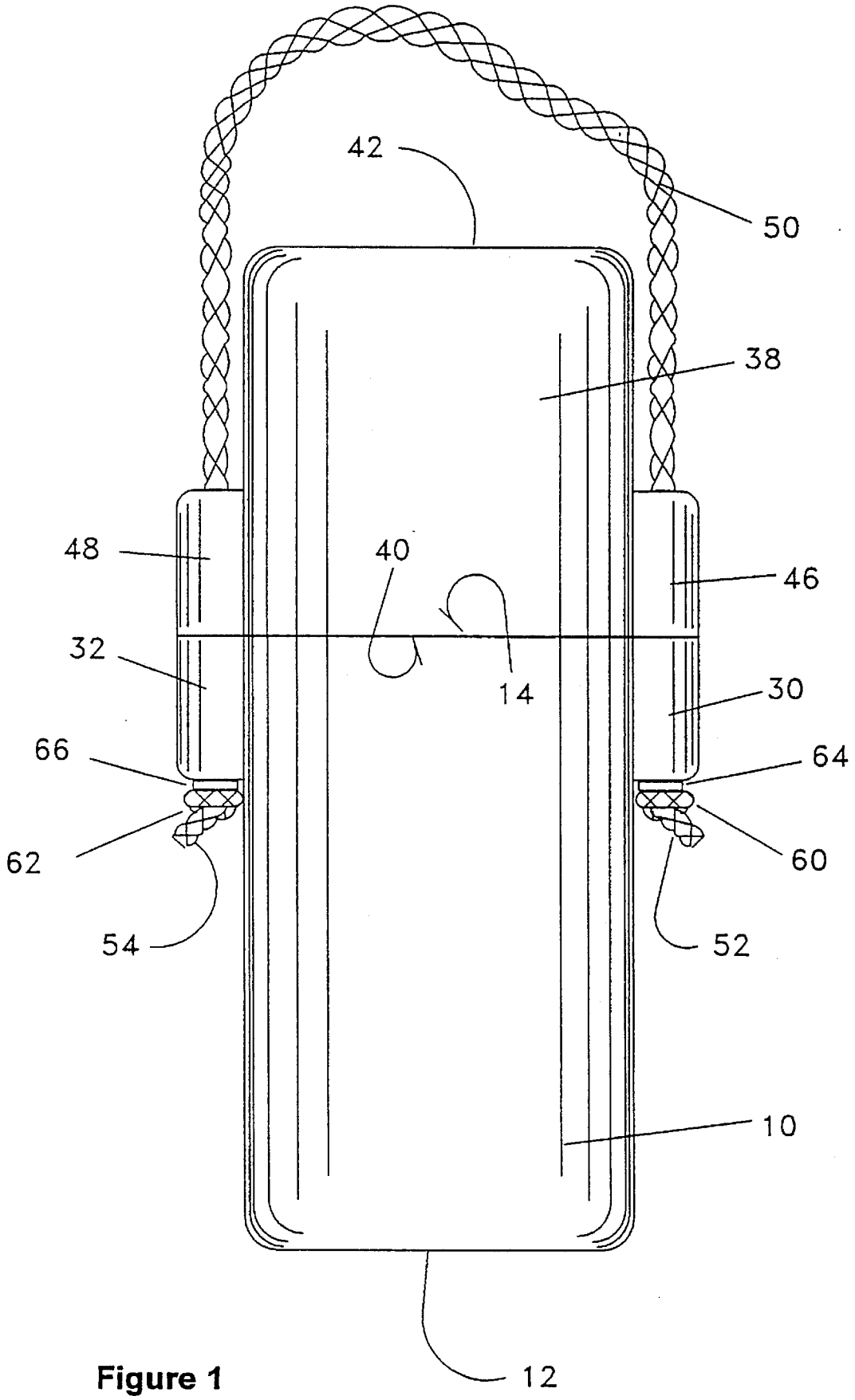
FIG. 1 is an elevational external view of a portable carrier for a beverage container that incorporates principals of the invention. In this view, the cover member is in closed position.
Figure 2:
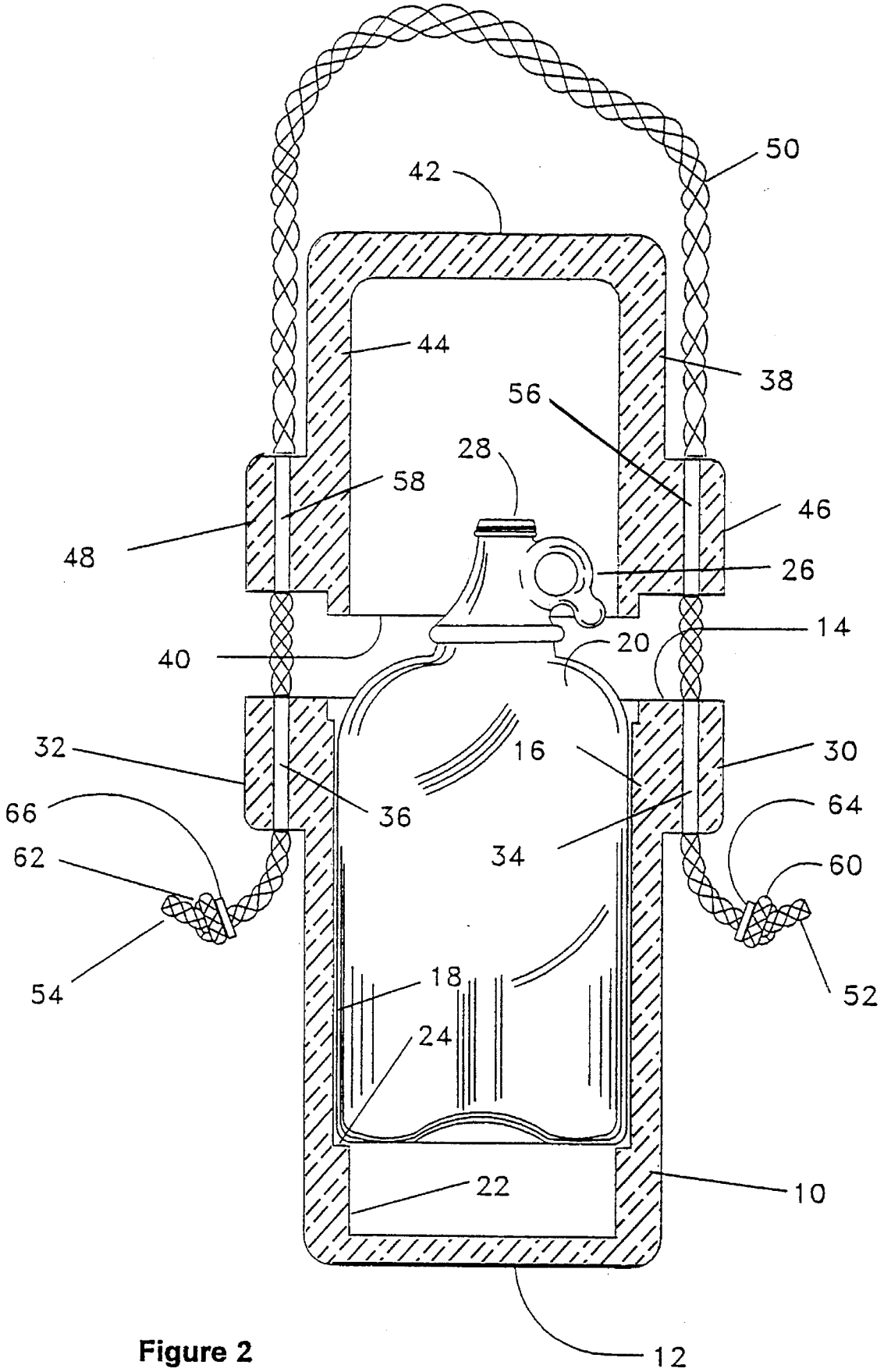
FIG. 2 is an elevational cross-sectional view of the portable carrier showing a growler jug container positioned within the carrier base member and showing the cover member slightly elevated with respect to the base member.
Figure 3:
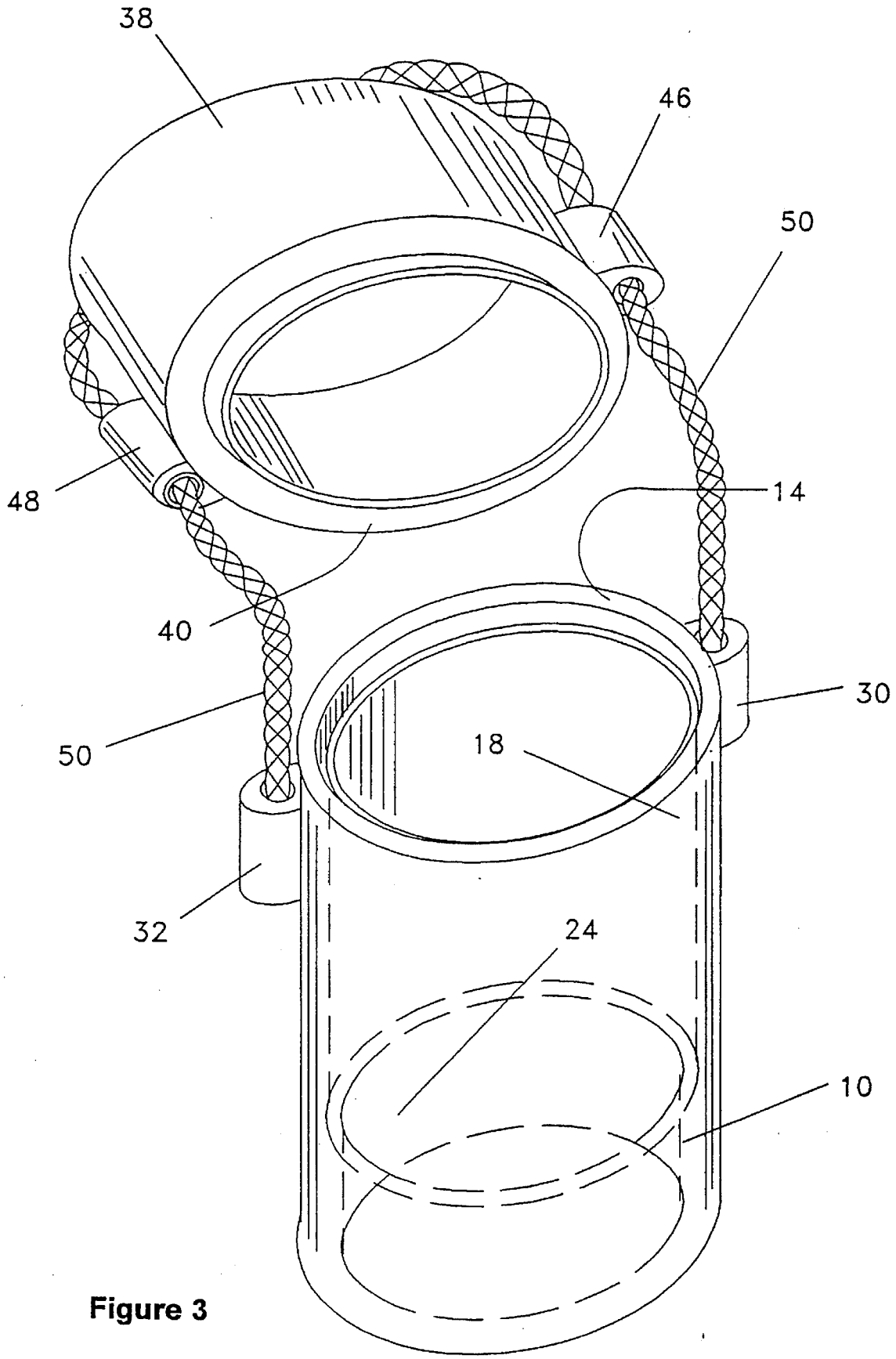
FIG. 3 is an isometric view of the portable carrier showing the cover member removed from the base member and showing the interior of both the cover member and the base member.

Referring first to FIGS. 1, 2 and 3, the basic concepts of the invention are illustrated. The portable carrier includes a base member 10 having a closed bottom 12 and an open top 14 with a cavity 16 communicating with open top 14. The cavity is defined by a first upper portion 18 of a selected cross-sectional area dimensioned to receive a beverage container 20 therein. Cavity 16 is further defined by a second, lower portion 22 that has a reduced cross-sectional area. The difference in the cross-sectional areas of cavity upper portion 18 and lower portion 20 provides an internal circumferential ledge 24.

Beverage container 20 illustrated in FIG. 2 is the type known as a "growler jug", that is, a size jug commonly employed for transporting beverage, particularly beer. The typical growler jug 20 has a handle 26 and a removable cap 28 so that the growler jug can be reusable.

Integrally formed as a part of base portion 10 are enlarged external bosses 30 and 32 that are diametrically opposed to each other. The bosses have openings 34 and 36 respectively. Openings 34 and 36 each are axially aligned parallel to each other and parallel to a longitudinal axis (not shown) of the cavity 16 and base member 10.

The second major element of the portable carrier is a cover member 38 having an open bottom 40 and a closed top 42. Communicating with open bottom 40 is a cavity 44. Integral enlarged dimensioned external boss portions 46 and 48 are provided on opposite sides of the exterior of the cover member.

The configuration of cover member 38 at the lower end 40 is such as to matingly and telescopically engage the upper open top 14 of base member 10 so that the cover member is retained in alignment with base member 10 when in the closed position as shown in FIG. 1.

Cavity 44 is suitable for receiving the upper portion of a beverage container, such as growler jug 20 as illustrated in FIG. 2.

The portable carrier is carried by a cord or a short length rope 50 having a first end 52 and a second end 54. Cord first end 52 extends through an opening 56 in cover member boss portion 46 and through opening 34 in base member boss portion 30. In like manner, the cord second end 54 extends through an opening 58 in cover member boss portion 48 and through opening 36 in base member boss portion 32. A knot 60 is tied in cord 50 adjacent end 52 and, in like manner, a knot 62 is tied in the cord adjacent end 54. Instead of knots 60 and 62, other means such as a physical device could be attached to the rope. The function of the knots 60 and 62 is to prevent the ends of the cord from pulling back through openings 34 and 36.

Base member 10 and cover member 38 are preferably formed of insulating material and an ideal material is foam plastic. When these components are made of foam plastic a preferred arrangement includes the use of washers 64 and 66, which can be made of metal or stiff plastic. The washers are received on the cord above knots 60 and 62. Washers 64 and 66 prevent knots 60 and 62 from being pulled through openings 34 and 36 and add to the weight carrying capacity of the portable carrier.

Figure 5:
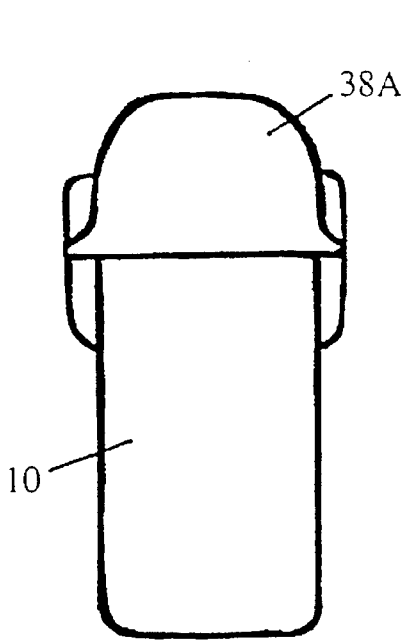
FIG. 5 is an elevational view as taken along the line 5—5 of FIG. 4 showing the rearward view of the carrier of FIG. 4 having the specially designed cover member.
Figure 4:
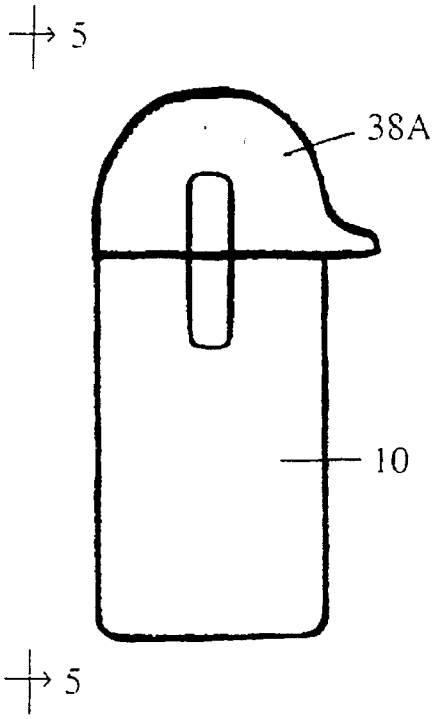
FIG. 4 is a reduced scale external elevational view of an alternate embodiment of the invention in which the cover member is configured like a baseball cap with a short bill or like a jockey helmet. The cord by which the device is carried is not shown.

To add novelty to the portable carrier for a beverage container as illustrated in FIGS. 1–3, the cover member 42 may be varied in external configuration. For instance, FIGS. 4 and 5 show the cover member 38A having an external configuration in the shape of a baseball cap, a jockey helmet, a construction helmet or other type of hat or helmet. Cover member 38A has an internal recess as shown in FIG. 2. FIGS. 4 and 5 do not show a cord but it is understood that the cord would be provided in the same way as previously described.

Figure 7:
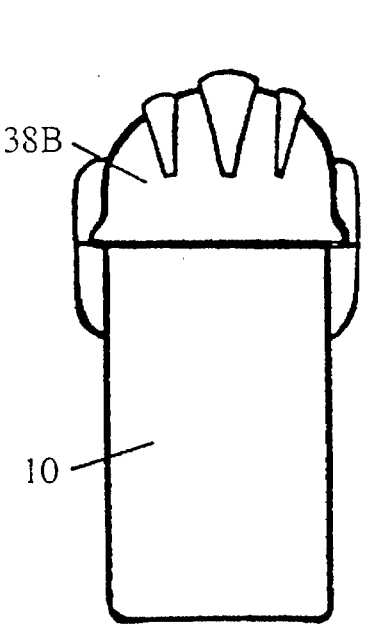
FIG. 7 is an elevational view of the embodiment of FIG. 6 as taken along the line 7—7 of FIG. 6.
Figure 6:
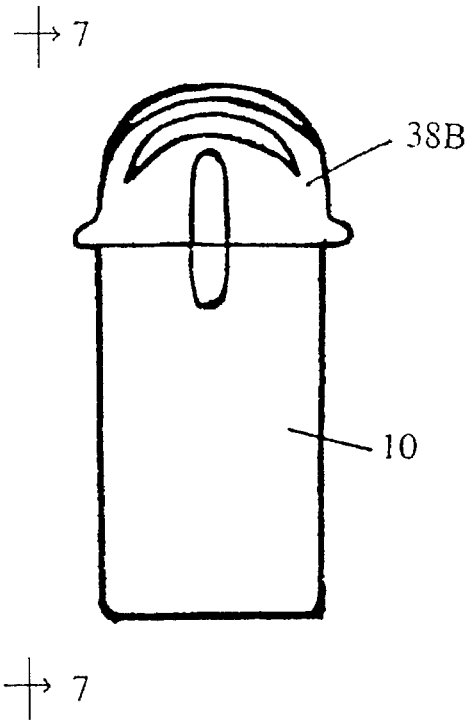
FIG. 6 is an external elevational view in reduced scale of an alternate embodiment of the invention showing a cover member having an external shape of a different style of hat or helmet.

FIGS. 6 and 7 show another alternate embodiment of the configuration of the cover member indicated by the numeral 38B. As with FIGS. 4 and 5, the embodiment of FIGS. 6 and 7 do not show the use of a cord which would be employed in the same way as illustrated in FIGS. 1–3.

The portable carrier as illustrated and described herein has many advantages over similar carrier devices of the prior art. Integral ledge 24 formed within base member 10 provides a recess for ice to keep the contents of the beverage container cool. In addition, the lower portion 22 of the cavity allows for additional height so that if a beverage container is employed having an external diameter less than the internal diameter of cavity lower portion 22 a taller container can be retained within the portable carrier.

Cord 50 extends through integral bosses in both the cover member 38 and base member 10 allows the cover member to be easily removed from the base member in a way so that cover member 38 can never be misplaced or separated from the entire portable carrier assembly. Thus, cord 50 serves the dual purposes of providing an easy means for carrying the portable carrier and for retaining the cover member 38 in companionship with the base member 10. The length of cord 50 can vary. For instance, cord 50 can be made long enough that it can be looped over the shoulder of the user, or it can be shorter to be carried by hand.

The entire portable carrier consists of only five elements, that is, base 10, cover member 38, cord 50 and washers 64 and 66—all of which can be inexpensively made.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A portable carrier for a beverage container comprising:

a unitary base member molded of foam plastic having a closed bottom and an open top, the open top communicating with a cavity in the base member, the cavity being defined by a first upper portion of selected cross-sectional area dimensioned to receive a beverage container and a second lower portion of reduced cross-sectional area less than that of the beverage container, providing an integral internal circumferential ledge spaced from said closed bottom forming an area adaptable to receive a predeterminable quantity of ice therein, the ledge being dimensioned to support the beverage container thereon, the base member having diametrically opposed integral enlarged dimensioned external portions adjacent said open top each having an opening therethrough;

a unitary cover member molded of foam plastic having a closed top and an open bottom, the open bottom communicating with a cavity in the cover member, the cover member and said base member having mating portions that telescopically engage each other in a removable relationship, the cover member having diametrically opposed integral enlarged dimensioned external portions adjacent said open bottom each having an opening therethrough;

a cord having opposed first and second ends that extend through said cover member openings, the cord looping over said cover member closed top, the cord first and second ends extending through said base member openings; and first and second stiff washers received on said cord adjacent respectively said cord first and second ends, said washers being positioned below said base member integral enlarged dimensioned external portions and knots tied in said cord adjacent said first and second ends thereof, said washers serving to prevent said knots from pulling through said openings, whereby said base member can be carried by said cord, said cord being of sufficient length that said cover member may be slid on said cord to fully expose said base member cavity to permit a beverage container to be positioned into or retrieved from said base member, said cover member being at all times secured to said base member by said cord.

* * * * *